United States Patent [19]

Crowley et al.

[11] 4,141,816

[45] Feb. 27, 1979

[54] PREVENTING AMMONIUM CHLORIDE DEPOSITION IN HYDROGEN RECYCLE STREAM

[75] Inventors: Ralph P. Crowley; Max G. Staples, both of Woods Cross, Utah

[73] Assignee: Phillips Petroleum Company, Bartlesville, Okla.

[21] Appl. No.: 811,356

[22] Filed: Jun. 29, 1977

[51] Int. Cl.[2] ..... C10G 23/00

[52] U.S. Cl. ..... 208/107; 208/133; 208/209; 208/254 H; 208/213

[58] Field of Search ..... 208/213, 209, 254 H, 208/107, 108, 134, 133, 135

[56] References Cited

U.S. PATENT DOCUMENTS

| | | | |
|---|---|---|---|
| 2,317,766 | 4/1943 | Hewlett et al. | 208/135 |
| 2,759,876 | 8/1956 | Teter et al. | 208/134 |
| 2,951,032 | 8/1960 | Inwood | 208/254 H |
| 2,959,537 | 11/1960 | Welty, Jr. | 208/134 |
| 2,983,676 | 5/1961 | Howland | 208/254 H |
| 3,277,199 | 10/1966 | Poll | 208/254 H |
| 3,412,010 | 11/1968 | Alpert et al. | 208/108 |
| 3,549, 517 | 12/1970 | Lehman et al. | 208/108 |
| 3,718,734 | 2/1973 | Christensen et al. | 208/108 |

*Primary Examiner*—George Crasanakis

[57] ABSTRACT

Deposition of ammonium chloride from gaseous streams is prevented by maintaining the temperature of the gaseous stream above the deposition temperature for ammonium chloride at operating pressure. The invention is particularly useful in hydrocarbon hydrogen treating processes in which hydrogen recycle streams containing ammonium chloride or ammonium chloride-forming constituents must be recompressed before recycle to the hydrogen treating process.

6 Claims, 1 Drawing Figure

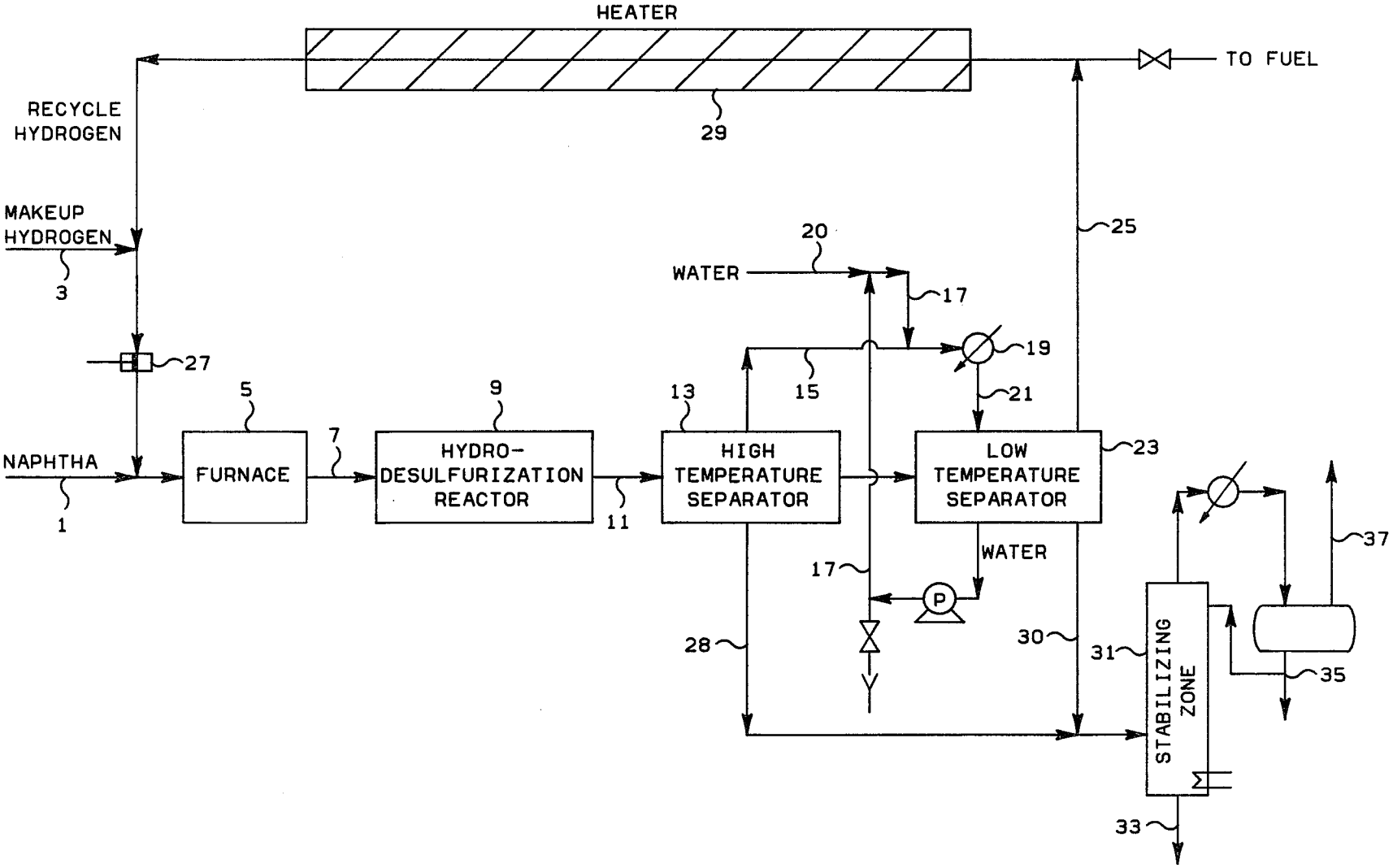
TO FUEL
HEATER
29
25
RECYCLE HYDROGEN
MAKEUP HYDROGEN
3
27
NAPHTHA
1
FURNACE
5
7
HYDRO-DESULFURIZATION REACTOR
9
11
HIGH TEMPERATURE SEPARATOR
13
WATER
20
15
17
19
21
LOW TEMPERATURE SEPARATOR
23
WATER
P
17
28
30
STABILIZING ZONE
31
33
35
37

PREVENTING AMMONIUM CHLORIDE DEPOSITION IN HYDROGEN RECYCLE STREAM

BACKGROUND OF THE INVENTION

This invention relates to the condensing and depositing of ammonium chloride contained in gaseous process streams. In one of its aspects this invention relates more particularly to hydrocarbon hydrodesulfurization, hydrodenitrogenation, hydrocracking, and reforming processes. In still another of its aspects this invention relates to a process in which ammonium chloride is present in a gaseous stream that must be subjected to gas compression with prevention of depositing of the ammonium chloride in the gas-compressing zone.

This invention is of particular interest in hydrodesulfurization processes in which hydrocarbon stock is passed along with hydrogen into a catalytic hydrodesulfurization zone in which they are contacted with a catalyst, usually a cobalt-molybdenum or nickel-molybdenum on alumina support catalyst, at a temperature and pressure sufficient to produce desulfurized hydrocarbons, hydrogen, and other gases. It is well known that, usually, among the products in a hydrodesulfurization effluent stream are ammonium chloride or ammonium chloride-forming constituents. On passing any part of the gaseous effluent stream containing ammonium chloride or ammonium chloride-forming constituents through a compressing zone there is a risk of problems with depositing of ammonium chloride on the equipment in the compressing zone. In turbine compressors, deposits of a solid ammonium chloride on the blades of the compressor can unbalance the blades and necessitate expensive shutdown. In reciprocating compressors the valve ports can become plugged, again necessitating expensive shutdown of the operation.

Various methods have been proposed for eliminating the depositing. These methods usually entail the removal of ammonium chloride or ammonium chloride-forming constituents from the process streams. As an example, U.S. Pat. No. 2,929,772 contacts the gas streams with an adsorbent or an absorbent upstream of the gas-compressing zone to remove the ammonium chloride or ammonium chloride-forming components. Other processes reduce the temperature to induce depositing in a zone from which the deposits can easily be washed prior to passing any portion of the reforming process effluent through a compression zone. Both of these methods require fairly expensive equipment which may leave a sufficient amount of material in the gas stream to allow troublesome deposits. The method of this invention provides relatively inexpensive means to prevent deposition within a given portion of the process such as a compression zone. The method is particularly effective when used along with means for removing at least some of the ammonium chloride or ammonium chloride-forming constituents.

It is therefore an object of this invention to provide a method for preventing depositing of ammonium chloride from a gaseous stream containing ammonium chloride or ammonium chloride-forming constituents. It is another object of this invention to prevent the deposition of ammonium chloride in the compression zone for hydrogen recycle in a catalytic hydrodesulfurization process.

Other aspects, objects, and the various advantages of this invention will become apparent upon study of this specification, the drawing, and the appended claims.

STATEMENT OF THE INVENTION

According to the invention a method is provided for preventing depositing of ammonium chloride from a gaseous stream containing ammonium chloride or ammonium chloride-forming constituents. The method comprises supplying indirect heat exchange to the gaseous stream in sufficient quantity to maintain the temperature of the stream above deposition temperature for ammonium chloride at the operating pressure in the gaseous stream. Although this method has arisen from experience in catalytic hydrodesulfurization processes and is therefore particularly applicable in the manipulation of hydrogen recycle streams in a hydrodesulfurization process, it is also broadly applicable to any gaseous stream from which it is desirable to prevent the deposition of ammonium chloride, as in hydrocracking, hydrodenitrogenation, and reforming.

The invention can best be understood in conjunction with the drawing which is a line diagram of a naphtha catalytic hydrodesulfurization unit (using conventional cobalt-molybdenum on alumina hydrodesulfurization catalyst) containing a recycle hydrogen line that is passed through a compression zone.

Referring now to the drawing, about 10,500 barrels per day of hydrocarbon feed containing 100 parts per million by weight of sulfur is passed through line 1 along with about 3.8 million standard cubic feet per day of make-up hydrogen containing up to about 1 ppm of hydrogen chloride through line 3 and 3.5 million standard cubic feet per day via compressor 27 of recycle hydrogen, containing $NH_4Cl$ vapor in an amount of about 0.01 parts per million by weight, into the hydrodesulfurization heater 5. In the heater the temperature is raised from approximately 450° F. (232° C.) at a pressure of 460 psig (3175 kPa gage) to a temperature of about 600° F. (316° C.) at 420 psig (2900 kPa gage). The heated stream is passed through line 7 into the hydrodesulfurization reactor 9 in which catalytic hydrodesulfurization takes place. Nitrogen compounds in the stock to be hydrodesulfurized and the hydrogen chloride present in the hydrogen stream and produced from organic chlorides in the feed provide the necessary constituents in the hydrodesulfurization reaction to provide either ammonium chloride or ammonium chloride-forming constituents ($NH_3$ and HCl) in the reactor effluent.

In hydrodesulfurization, besides sulfur compounds, the feed contains nitrogen compounds, and some feeds contain organic chloride and organic nitrogen compounds. The source of hydrogen used is usually from a reforming operation (naphtha reforming) which yields hydrogen. HCl or other chlorides are added to such reforming operations and are one source of HCl added to hydrodesulfurization in this hydrogen stream. Also, in some operations ammonia is added to the water added to a vapor stream recovered from hydrodesulfurization to minimize corrosion in the system.

The reactor effluent is passed by line 11 to a high-temperature separator 13 from which vapor at about 335° F. (168.8° C.) and 370 psig (2550 kPa gage) is withdrawn through line 15. This vapor can contain up to about 15 to 20 pounds per day of ammonium chloride or ammonium chloride-forming constituents. The vapor from line 15 is contacted with water in line 17, make-up water being added at 20, passed through indirect cooling 19, line 21, and into a low-temperature separator 23. This removes the major portion of the HCl and $NH_3$ as $NH_4Cl$ in the water. On exit from the low-temperature separator 23 the recycle hydrogen stream passing into line 25 has reached a temperature of 100° F. (38° C.) at about 350 psig (2415 kPa gage). These conditions are such that $NH_4$ and HCl or $NH_4Cl$ are present in the recycle hydrogen and there is the problem of deposition of ammonium chloride in the recycle compressor and conduits associated therewith.

Liquid hydrocarbon from the high-temperature separator 13 is passed through line 28 which is joined by hydrocarbon liquid passed through line 30 from low-temperature separator 23 into a stabilizing system 31 from which a bottoms stream of about 6,000 barrels per day of hydrocarbons containing less than 1 part per million sulfur is withdrawn through line 33, an overhead liquid stream of about 4,000 barrels per day of hydrocarbon is withdrawn through line 35 and an overhead gas stream of about 1 million standard cubic feet per day is withdrawn through line 37.

The recycle hydrogen stream withdrawn from the low-temperature separator 23 through line 25 contains about 0.01 parts per million by weight ammonium chloride or ammonium chloride-forming constituents at a temperature of about 100° F. (38° C.) and at 350 psig (2415 kPa gage). Experience with this stream indicates and a calculation from published data corroborates that at these conditions deposition of ammonium chloride from the hydrogen recycle stream can be expected with any further drop in temperature. Under actual operating plant conditions there is enough natural heat exchange during winter weather to cause condensation and depositing of ammonium chloride either in compression zone 27 or in line 25 to be carried into the compression zone. To prevent this deposition a heated zone 29 is provided on recycle hydrogen line 25, supplying sufficient indirect heat to raise the temperature in the recycle hydrogen line to the range of 105°–110° F. (40.8°–43° C.) at 350 psig (2415 kPa gage) which is sufficient to maintain $NH_4Cl$ as vapor in the hydrogen stream.

Various indirect heat exchange means are well known which are capable of supplying sufficient heat to the transfer line to prevent deposition, among these are heating jackets or tubing containing hot water, steam, or other heating fluids. An electric resistance heater can also be used.

We claim:

1. A method for preventing deposition of ammonium chloride in a hydrogen recycle stream, said hydrogen stream being recycled from a low temperature separator through a gas compression means and into a hydrogenation reactor, said method comprising supplying indirect heat exchange to said recycle stream upstream of said gas compression means, said heat exchange being sufficient to maintain the temperature of said recycle stream above the deposition temperature for ammonium chloride.

2. A method of claim 1 wherein said process is a hydrocarbon treating process.

3. A method of claim 2 wherein said process is a hydrocracking process.

4. A method of claim 2 wherein said process is hydrodenitrogenation process.

5. A method of claim 2 wherein said process is a hydrogen reforming process.

6. A method of claim 2 wherein said process is a naphtha hydrodesulfurization process.

* * * * *